US007687413B2

(12) United States Patent
Schmitt

(10) Patent No.: US 7,687,413 B2
(45) Date of Patent: Mar. 30, 2010

(54) EDGECOMB RESISTANCE POLYESTER

(75) Inventor: Thomas E. Schmitt, Concord, NC (US)

(73) Assignee: Invista North America S.A.R.L., Wilmington, DE (US)

( * ) Notice: Subject to any disclaimer, the term of this patent is extended or adjusted under 35 U.S.C. 154(b) by 754 days.

(21) Appl. No.: 10/923,301

(22) Filed: Aug. 20, 2004

(65) Prior Publication Data

US 2006/0040577 A1 Feb. 23, 2006

(51) Int. Cl.
*B32B 5/02* (2006.01)
*B32B 27/02* (2006.01)

(52) U.S. Cl. ..... 442/154; 442/164; 139/389

(58) Field of Classification Search ..... 442/59, 442/154, 76, 164, 104
See application file for complete search history.

(56) References Cited

U.S. PATENT DOCUMENTS 3,296,169 A * 1/1967 Corey ..... 524/561
3,705,645 A 12/1972 Konen
5,800,883 A 9/1998 Koseki
6,169,043 B1 1/2001 Li
6,291,040 B1 9/2001 Moriwaki et al.
6,348,543 B1 2/2002 Parker
6,468,929 B2 10/2002 Parker
6,545,092 B2 4/2003 Parker
7,001,949 B2 * 2/2006 Fasano et al. ..... 525/70
7,049,352 B2 * 5/2006 Gould et al. ..... 523/201
2002/0194680 A1 * 12/2002 Park ..... 8/115.51

* cited by examiner

*Primary Examiner*—Lynda Salvatore

(57) ABSTRACT

The present invention concerns polyester fabric that is employed in airbags. In particular, the polyester fabric has improved resistance to edge combing—the relative tendency of a fabric to pull apart under seam stress or similar action such as inflation of inflatable restraints. Further, the polyester fabric of the invention must have an edge comb resistance of greater than about 350 Newtons at room temperature (20° C.) and greater than 250 Newtons at 90° C. The polyester fabric of the invention has an acrylic polymer or copolymer finish, or a mixture of acrylic and non-acrylic polymers. The finish is applied from about 1 to about 4 wt. % nominal solids add-on of said fabric.

13 Claims, No Drawings

EDGECOMB RESISTANCE POLYESTER

BACKGROUND OF THE INVENTION

1) Field of the Invention

The present invention concerns polyester fabric that is employed in airbags. In particular, the polyester fabric has improved resistance to edge combing—the relative tendency of a fabric to pull apart under seam stress or similar action such as inflation of inflatable restraints. Further, the polyester fabric of the invention must have an edge comb resistance of greater than about 350 Newtons at room temperature (20° C.) and greater than 250 Newtons at 90° C. The polyester fabric of the invention has an acrylic polymer, copolymer, or polymer blend finish applied from about 1 to about 4 wt. % nominal solids add-on of said fabric.

2) Prior Art

Conventional air bags are produced by coating or laminating a plain weave fabric with an elastomer resin such as a synthetic rubber, for example chloroprene, chlorosulfonated olefin or silicone, to provide a base fabric with low air permeability, and cutting and sewing the base fabric into bags. The elastomer resin is applied to the surface of the base fabric in an amount of 90 to 120 g/m$^2$, and the air bag produced is very heavy, hard and coarse in appearance. Furthermore, when it is folded into a compact module, it is hard to fold. If the base fabric is coated with silicone elastomer resin, the air bag is considerably more heat resistant and cold resistant than an air bag having a base fabric coated with chloroprene elastomer resin. Moreover, the amount of resin coated is only 40 to 60 g/m$^2$, thus allowing a reduction in weight and an improvement in appearance and foldability.

U.S. Pat. Nos. 6,545,092, 6,348,543 and 6,468,929 to Parker discloses a coating to improve edge comb resistance. This coating is a cross-linked blend of polyalkyl/polyphenoxy siloxane with a copolymer of ethylene and methacrylate.

U.S. Pat. No. 3,705,645 to Konen discloses an acrylic polymer coating as a film laminate on the inside of the airbag.

U.S. Pat. No. 5,800,883 to Koseki discloses a polyurethane resin coated airbag.

Many others used silicone resin coatings that also created a film on top of the fibers thereby creating an air impermeable airbag. These airbags exhibit reduced seam combing. It is also known to use a silicone/urethane or silicone/acrylic copolymer coating to improve tear strength.

U.S. Pat. No. 6,169,043 to Li discloses an airbag coated with polyacrylate and polyurethane copolymer resin to reduce air permeability. No mention is made of seam or edge combing. This patent shows that polyacrylate by itself is inferior to polyacrylate and polyurethane copolymer resin with respect to air permeability.

U.S. Pat. No. 6,291,040 to Moriwaki et al discloses a nylon airbag fabric thinly coated with an thermoplastic synthetic resin, preferably a polyurethane or polyester based resin to prevent edge combing by bridging the interstices of the fabric with the resin.

However, as yet, such improvement is not regarded as sufficient. The coating must withstand extreme conditions in the folded state. For instance the coating must not crack or become sticky, and the airbag must deploy without seam combing (the relative tendency of a fabric to pull apart under stress, due to inflation, at the seams) after prolonged storage at −40° C., and at 90° C.

In addition, it is also demanded that the base fabric for air bags be less expensive and more easily folded for reducing the size of the module. Thus, air bags using non-coated base fabrics have attracted attention. However, they become frayed during sewing and exhibit seam combing.

Uncoated nylon fabrics for airbags have edge comb resistance that are superior to polyester fabric used for the same purpose. To make polyester airbags competitive with nylon airbags, it is desirable to increase the edge comb resistance of polyester fabrics used in airbags. There is therefore a need for an uncoated polyester air bag that exhibits equivalent or superior edge comb resistance at ambient and high temperatures.

SUMMARY OF THE INVENTION

The present invention recognizes that polyester airbags have an inferior edge combing resistance as compared to nylon air bags. Nylon air bag fabrics have an edge combing resistance of at least 350 N at room temperature and greater than 250 N at 90° C. To increase the edge combing resistance of polyester airbags and not affect the air permeability the present invention does not employ a film-forming web on the airbag fabric. In fact, the present invention uses a finish that coats the fibers of the fabric, but does not form a film on the fabric itself. In this manner, the finish greatly improves the edge combing resistance without affecting the other fabric properties such as foldability.

In the broadest sense, the present invention relates to a plain weave polyester fabric having an edge comb resistance greater than about 350 N at room temperature and greater than 250 N at 90° C.

In the broadest sense, the present invention also relates to polyester airbag having an edge comb resistance greater than about 350 N at 20° C. and greater than about 250 N at 90° C., said airbag having an acrylic acid ester polymer finish.

In the broadest sense, the present invention also relates to polyester airbag having an edge comb resistance greater than about 350 N at 20° C. and greater than about 250 N at 90° C., said airbag having a non-film-forming finish.

In the broadest sense, the present invention also relates to a plain weave polyester fabric, having an edge comb resistance greater than about 350 N at room temperature and greater than 250 N at 90° C., which has been coated with an elastomer.

DESCRIPTION OF THE PREFERRED EMBODIMENTS

In the simplistic form, the present invention concerns a polyester fabric having a finish of acrylic acid ester polymer. Polyester fibers and fabrics for airbags are well known. Invista, Inc., formerly KoSa, sells a low profile fiber that is designated as 650d T771.

Polyethylene terephthalate (PET) homopolymer is prepared by one of two processes, namely: 1) the ester interchange process and 2) the direct esterification process. In the ester interchange process, dimethyl terephthalate (DMT) is reacted with ethylene glycol (transesterification) to yield bis (2-hydroxy ethyl)terephthalate (monomer) along with minor amounts of other reaction products (oligomers), and methanol. Because the reaction is reversible, it is necessary to remove the methanol to completely convert the raw materials into monomer. It is known to use magnesium and/or cobalt and/or zinc in the ester interchange reaction. The catalyst activity is then sequestered by introducing phosphorus, for example, in the form of polyphosphoric acid (PPA), at the end of the ester interchange reaction. The monomer then under goes a condensation process (polycondensation) which polymerizes the monomer to PET. When the monomer under goes polycondensation, the catalyst most frequently employed is antimony. If the catalyst employed in the ester interchange reaction is not sequestered with phosphorus, the resultant polymer easily degrades (thermodegradation) and has a very unacceptable yellow color.

The second method of making PET is to react terephthalic acid (TA) and ethylene glycol by a direct esterification reaction producing bis(2 hydroxyethyl) terephthalate, oligomers, and water. This reaction is also reversible and thus can be carried to completion by removing the water during the reaction process. The direct esterification step does not require a catalyst and conventionally no catalyst is employed. Just as in the DMT process, the monomer then under goes polycondensation to form PET. The polycondensation reaction typically uses antimony as a catalyst, however, titanium in the form of a titanium compound is also a respected typical catalyst.

The polyester homopolymer of the present invention was then spun, and drawn, relaxed, and wound on a bobbin as described in U.S. Pat. No. 6,471,906 to DeBenedictis et al. This patent is hereby incorporated by reference thus describing a suitable process for manufacturing the fiber of the present invention. Other known processes for relaxing the fiber may also be employed with the present invention provided such processes achieve at least a minimum 8% relax.

Weaving the fiber into a plain 1×1 fabric may be done using any conventional equipment known to those in the trade. A typical fabric has about 42×42 yarns per inch (16.5×16.5 yarns per cm).

The term "acrylic acid ester polymer" means a polymer composed at least partially of a structural unit derived from an acrylic acid ester. Typical monomers include methyl, ethyl, n-butyl, iso-butyl, 2-ethylhexyl, and octyl acrylic acids and mixtures thereof. It does not mean only an acrylic acid ester homopolymer but also embraces a copolymer of an acrylic acid ester and another polymerizable monomer, such as methacrylates, styrene, vinyl acetate, polyester, and acrylonitrile. Blends of acrylic acid esters with other polymers is also embraced.

Acrylic acid ester polymers are commercially available as textile binders from Rohm & Haas (Rhoplex®), Eastman Chemical (Rheoprint®—copolymer of acrylic acid ester and polyester, and Qualbond®—copolymer of polystyrene and acrylic), National Starch (Nacrylic®) and B.F. Goodrich (Hycar®).

The acrylic acid ester polymer is diluted in an aqueous solution and applied to the plain weave fabric from about 1 to about 4 wt. % nominal solids add-on of said fabric. More preferably, the finish is applied from about 1 to 2 wt. % solids add-on to the fabric. The finish may be applied by spraying, immersion, brushing, meniscus roller, or any known suitable process. Preferably it is applied by immersion.

After the finish is applied and dried on the fabric (either by use of an oven or room temperature drying) it may then be tested for edge combing resistance. It is known that uncoated nylon fabrics have edge comb resistance of at least 350 N at room temperature. Therefore this is the minimum resistance suitable for the present invention.

Test Procedures

The edge comb resistance of the woven fabric was measured according to ASTM D 6479-02, using a 50 mm wide strip of fabric. Measurements were made at 20° and 90° C. One end of a test specimen is clamped within one jaw of a CRE tensile testing machine and a special fixture pierces arrow of equally spaced needle holes through the opposite end of the specimen. In accordance with Test Method D 5035, a tensile force is applied to the specimen until rupture occurs. The measurement of the force required to cause rupture is the measurement of edge comb resistance.

The finish glass transition temperature (Tg) was measured by DSC, using a 10 mg sample and a heating rate of 10° C./min from −50° to +50° C. The sample was dried in a dessicator for 12 hours prior to the measurement.

EXAMPLES

Unless otherwise noted, the yarns were woven in a plain weave with a nominal 42×42 ends per inch (16.5×16.5 ends per cm). The woven fabric was scoured at 60° C. and dried at 177° C. respectively, according to conventional methods. The woven fabric was immersed in a diluted resin solution of an acrylic fabric finish. The fabric was pressed smooth by a mangle at 3 Kg/cm2. The woven fabric was thermally set at 160° C. for 45 seconds, to obtain a base fabric for air bags. The nominal solids add-on of the acrylic finish was 1.5 wt-%.

Example 1 (Comparative)

Base polyester and nylon fabrics were prepared according to the general procedure without an immersion in the binder finish. The yarns were obtained from INVISTA, USA. The edgecomb resistance of these fabrics is set forth in Table 1. Additionally the base fabrics were sewn into passenger side airbag modules and deployed. It was noted, after heating at 90° C. for 4 hours, whether there was combing at the seams when the module was deployed.

TABLE 1

| | | Edgecomb resistance, N | | Combing on |
|---|---|---|---|---|
| Yarn | Denier | 20° C. | 90° C. | inflation |
| T769 Nylon | 630 | 370 | 330 | No |
| T771 Polyester | 650 | 300 | 250 | Yes |

These results illustrate the superiority of uncoated nylon over uncoated polyester with respect to seam combing.

Example 2

The 650 denier T771 woven fabric described in Example 1 was immersed in different baths of acrylic based binders sold by Eastman Chemical Co., USA. The level of finish and the edgecomb resistance is set forth in Table 2. This illustrates that various acrylic-based finishes markedly increased the edgecomb resistance of the polyester fabrics. Visual inspection of the fabrics showed that the finish coated the individual yarn filaments and that there was no film formation on the fabric.

TABLE 2

| Binder Finish | Finish Tg,° C. | Finish, wt-% | Edgecomb resistance, N at 20° C. |
|---|---|---|---|
| None | — | — | 300 |
| Rheoprint 2000 | −16 | 2 | 945 |
| VC-1 | −12 | 2 | 790 |
| Builder 545 | −18 | 3 | 835 |

Example 3

Base polyester and nylon fabrics were prepared according to the general procedure. The nylon fabric was a plain weave with 41×41 ends per inch (16.1×16.1 ends per cm). Rheoprint 2000 (a polyester-acrylic finish having a Tg of −16° C.) and Qualbond (a polystyrene-acrylic finish having a Tg of +13° C.) finishes were applied to the polyester base fabrics. The edgecomb resistance was measured at 20° and 90° C., and the results set forth in Table 3

TABLE 3

| Fabric | Finish | Edgecomb resistance, N | |
|---|---|---|---|
| | | 20° C. | 90° C. |
| 630 d Nylon T728 | None | 370 | 330 |
| 650d Polyester T771 | 2 wt-% Rheoprint | 830 | 280 |
| 650d Polyester T771 | 1 wt-% Qualbond | 585 | 435 |

This example illustrates that the addition of a low level of an acrylic fabric finish markedly increases the edgecomb resistance of polyester fabrics, even at 90° C. Furthermore, a finish with a higher Tg retains a higher edgecomb resistance at 90° C. Visual inspection of the fabrics with binder finish showed that the finish coated the individual yarn filaments and that there was no film formation on the fabric. This was confirmed by measuring the air permeability which was unchanged from the base uncoated fabric.

Example 4

Fabrics containing 440 denier T791 polyester filament yarns were woven, scoured and treated with 1 wt. % and 2 wt. % Rheoprint 2000 fabric finish. These treated fabrics were coated (30 g/m$^2$) with a 2-part liquid silicone rubber. The edgecomb resistance of the uncoated and coated fabrics was measured at room temperature (20° C.) and the results are set forth in Table 4.

TABLE 4

| Rheoprint, wt-% | Edgecomb resistance, N | |
|---|---|---|
| | uncoated | coated |
| 0 | 410 | 500 |
| 1 | 620 | 550 |
| 2 | 690 | 690 |

This example illustrates that the acrylic finish is the major contributor to the improvement in edgecomb resistance even in coated airbag fabrics.

Thus it is apparent that there has been provided, in accordance with the invention, a woven fabric of polyester with an acrylic based finish that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A woven polyester fabric having from about 1 to about 4 wt. % nominal solids add-on of an acrylic based finish thereon, said fabric having an edge comb resistance greater than 350 Newtons at room temperature and greater than 250 Newtons at 90° C.; wherein said fabric is further characterized by:

i) said finish coating the polyester fibers from which said fabric is woven without forming a film on said fabric itself; and ii) having an air permeability not substantially changed from an identical fabric not treated with said finish.

2. The woven polyester fabric of claim 1, wherein said finish is from about 1 to about 2 wt % nominal solids add-on of said fabric.

3. A woven polyester fabric having an acrylic acid ester polymer finish thereon, said fabric having an edge comb resistance greater than 350 Newtons at room temperature and greater than 250 Newtons at 90° C.; wherein said fabric is further characterized by:

i) said finish coating the polyester fibers from which said fabric is woven without forming a film on said fabric itself; and ii) having an air permeability not substantially changed from an identical fabric not treated with said finish.

4. The woven polyester fabric of claim 3, wherein said acrylic acid ester polymer is prepared from monomers including methyl, ethyl, n-butyl, iso-butyl, 2-ethylhexyl, and octyl acrylic acids and mixtures thereof.

5. The woven polyester fabric of claim 3, wherein said polymer is a copolymer of an acrylic acid ester and another polymerizable monomer.

6. The woven polyester fabric of claim 5, wherein said polymerizable monomer is selected from methacrylates, styrene, vinyl acetate, and acrylonitrile.

7. The woven polyester fabric of claim 1, wherein said fabric is a plain weave having about 42×42 yarns per inch (16.5×16.5 yarns per cm.).

8. The woven polyester fabric of claim 3 wherein said fabric is coated with an elastomer.

9. A polyester airbag having an edge comb resistance greater than 350 Newtons at 20° C. and greater than 250 Newtons at 90° C., said airbag comprising a fabric having an acrylic acid ester polymer finish; wherein said fabric is further characterized by:

i) said finish coating the polyester fibers from which said fabric is woven without forming a film on said fabric itself; and ii) having an air permeability not substantially changed from an identical fabric not treated with said finish.

10. The polyester airbag of claim 9, wherein said acrylic acid ester polymer is prepared from monomers including methyl, ethyl, n-butyl, iso-butyl, 2-ethylhexyl, and octyl acrylic acids and mixtures thereof.

11. The polyester airbag of claim 9, wherein said polymer is a copolymer of an acrylic acid ester and another polymerizable monomer.

12. The polyester airbag of claim 11, wherein said polymerizable monomer is selected from methacrylates, styrene, vinyl acetate, and acrylonitrile.

13. The polyester airbag of claim 9, wherein said finish is from about 1 to about 4 wt. % nominal solids add-on of said airbag.

* * * * *